US010269319B2

(12) United States Patent
Um et al.

(10) Patent No.: US 10,269,319 B2
(45) Date of Patent: Apr. 23, 2019

(54) DISPLAY DEVICE AND DRIVING METHOD THEREOF

(71) Applicant: BOE TECHNOLOGY GROUP CO., LTD., Beijing (CN)

(72) Inventors: Yoonsung Um, Beijing (CN); Zheng Fang, Beijing (CN); Chengte Lai, Beijing (CN); Yunsik Im, Beijing (CN); Yankai Gao, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 15/571,623

(22) PCT Filed: Jun. 22, 2017

(86) PCT No.: PCT/CN2017/089528
§ 371 (c)(1),
(2) Date: Nov. 3, 2017

(87) PCT Pub. No.: WO2018/019061
PCT Pub. Date: Feb. 1, 2018

(65) Prior Publication Data

US 2018/0240430 A1 Aug. 23, 2018

(30) Foreign Application Priority Data

Jul. 26, 2016 (CN) ..... 2016 1 0597264

(51) Int. Cl.
*G09G 3/36* (2006.01)

(52) U.S. Cl.
CPC ..... *G09G 3/3677* (2013.01); *G09G 3/3614* (2013.01); *G09G 3/3696* (2013.01);
(Continued)

(58) Field of Classification Search
CPC ... G09G 2320/0252; G09G 2320/0261; G09G 2330/021; G09G 2310/0251;
(Continued)

(56) References Cited

U.S. PATENT DOCUMENTS 4,635,127 A 1/1987 Togashi
5,748,169 A 5/1998 Okumura et al.
(Continued)

FOREIGN PATENT DOCUMENTS

CN 101276564 A 10/2008
CN 101675374 A 3/2010
(Continued)

OTHER PUBLICATIONS

International Search Report & Written Opinion dated Aug. 30, 2017, regarding PCT/CN2017/089528.

*Primary Examiner* — Duc Q Dinh
(74) *Attorney, Agent, or Firm* — Intellectual Valley Law, P.C.

(57) ABSTRACT

A display device and a driving method thereof are provided. The driving method includes supplying a first voltage Vp1 to a sub-pixel of the display device through data lines in a first stage of a control period for displaying an image. A time for displaying the image includes a plurality of control periods, and the control period includes the first stage and at least a second stage following the first stage. The driving method also includes supplying a second voltage Vp2 to the sub-pixel through the data lines in the second stage. A gate scanning frequency of the first stage is F1 and a gate scanning frequency of the second stage is F2. When the first stage ends, the sub-pixel has a pixel voltage Vp3, F1<F2, and |Vp1|≥|Vp2|>|Vp3|.

20 Claims, 5 Drawing Sheets

(52) U.S. Cl.
CPC ..... *G09G 2320/0247* (2013.01); *G09G 2320/103* (2013.01); *G09G 2330/021* (2013.01); *G09G 2340/16* (2013.01)

(58) Field of Classification Search
CPC ..... G09G 3/3614; G09G 2320/043; G09G 3/3655; G09G 3/2022; G09G 2310/0248; G09G 2320/0257; G09G 2310/06; G09G 2320/0247; G09G 2320/0209; G09G 3/3648; G09G 2320/0233; G09G 3/3233; G09G 2320/045
USPC ..... 345/98–100
See application file for complete search history.

(56) References Cited

U.S. PATENT DOCUMENTS

| | | | | |
|---|---|---|---|---|
| 7,924,276 | B2 * | 4/2011 | Tsuda | G02F 1/136213 345/211 |
| 9,123,284 | B2 * | 9/2015 | Yoshida | G09G 3/2025 |
| 9,632,228 | B2 * | 4/2017 | Teragawa | G02B 6/0055 |
| 9,711,094 | B2 * | 7/2017 | Lee | G09G 3/3648 |
| 2002/0171640 | A1 * | 11/2002 | Bu | G09G 3/2011 345/208 |
| 2008/0239180 | A1 | 10/2008 | Sekine | |
| 2010/0134473 | A1 | 6/2010 | Matsuda et al. | |
| 2016/0189616 | A1 | 6/2016 | Oh et al. | |

FOREIGN PATENT DOCUMENTS

| | | | |
|---|---|---|---|
| CN | 103257498 | A | 8/2013 |
| CN | 105654892 | A | 6/2016 |
| CN | 105741798 | A | 7/2016 |
| CN | 106023934 | A | 10/2016 |

* cited by examiner

DISPLAY DEVICE AND DRIVING METHOD THEREOF

CROSS-REFERENCE TO RELATED APPLICATION

This application is a national stage application under 35 U.S.C. § 371 of International Application No. PCT/CN2017/089528, filed Jun. 22, 2017, which claims the priority of Chinese patent application No. 201610597264.9, filed on Jul. 26, 2016, the entirety of which is incorporated herein by reference.

FIELD OF THE DISCLOSURE

The present disclosure generally relates to the field of display technology and, more particularly, relates to a display device and a driving method thereof.

BACKGROUND

A thin film transistor liquid crystal display (TFT-LCD) is a flat panel display device and has many advantages, such as small size, low power consumption, no radiation and low production cost, etc. The TFT-LCD has been more and more used in high-performance display area.

When the TFT-LCD displays an image, gate lines are first scanned row by row to progressively select each row of the gate lines, and then voltage data is outputted to each sub-pixel through data line to finally realize display of the image. In general, when displaying an image frame, the frequency at which the gate lines are scanned is 60 Hz. To reduce the display power consumption, for example, when displaying a static image, the scanning frequency can be reduced.

Further, to avoid aging of the liquid crystal, polarity of the pixel voltage Vp supplied to the pixel electrode needs to be reversed even when displaying the static image at low frequency drive. Referring to FIG. 1*a*, the supplied pixel voltage at a first image frame (Frame 1) is (+m), the supplied pixel voltage at a second image frame (Frame 2) is (−m), and the above reversal process can be repeated during the driving process.

However, when the gate lines are scanned at a low frequency, the charge retention rate of the sub-pixel is lowered due to the decrease in the refresh rate of the display panel and the existence of leakage current in the TFT in the sub-pixel. Therefore, when the first image frame (Frame 1) ends, the absolute value of the voltage Vp charged to the sub-pixel is m', where m'<m, while when the second image frame (Frame 2) starts, the absolute value of the voltage Vp charged to the sub-pixel is still m. Thus, the voltage differences between the common voltage Vcom and the voltage charged to the sub-pixel before and after the polarity reversal in the adjacent two image frames are not equal. Therefore, referring to FIG. 1*b*, because the light passing through the liquid crystal molecules before and after the voltage reversal is different in a B region, the display luminance Lp in the B region significantly changes, causing the appearance of flicker on the display image and reducing the display effect.

The disclosed display device and driving method are directed to at least partially alleviate one or more problems set forth above and to solve other problems in the art.

BRIEF SUMMARY OF THE DISCLOSURE

One aspect of the present disclosure includes a driving method of a display device by supplying a first voltage Vp1 to a sub-pixel of the display device through data lines in a first stage of a control period for displaying an image. A time for displaying the image includes a plurality of control periods, and the control period includes the first stage and at least a second stage following the first stage. The driving method also includes supplying a second voltage Vp2 to the sub-pixel through the data lines in the second stage. A gate scanning frequency of the first stage is F1 and a gate scanning frequency of the second stage is F2. When the first stage ends, the sub-pixel has a pixel voltage Vp3, F1<F2, and |Vp1|≥|Vp2|>|Vp3|.

Optionally, the second voltage Vp2 has a polarity opposite to the first voltage Vp1 and the pixel voltage Vp3.

Optionally, the first stage includes a low-frequency stage, and the second stage includes a high-frequency stage.

Optionally, each control period includes a number N of second stages, wherein N≥2 and N is a positive integer and polarities of voltages respectively supplied to the sub-pixel in any adjacent two second stages are opposite to each other.

Optionally, values of the voltages sequentially supplied to the sub-pixel in the number N of second stages are sequentially increased.

Optionally, a maximum value of the voltages respectively supplied to the sub-pixel in the number N of second stages is smaller than or equal to the first voltage Vp1.

Optionally, scanning frequencies in the number N of second stages are equal to each other.

Optionally, in one control period. N×F1=F2.

Optionally, the voltages sequentially supplied to the sub-pixel in the number N of second stages form an arithmetic sequence, wherein a common difference X of the arithmetic sequence is |Vp1−Vp3|/N.

Optionally, the second frequency F2 is at least three times of the first frequency F1.

Another aspect of the present disclosure includes a display device. The display device includes a display panel including sub-pixels; a gate driver; a source driver; and a timing controller. The timing controller includes a dividing circuit, a gate timing controller, and a source timing controller. The dividing circuit is configured to divide a time for displaying an image into a plurality of control periods, and each control period includes a first stage and at least one second stage following the first stage. The gate timing controller is connected to the dividing circuit and the gate driver, and configured to output a gate timing control signal to the gate driver, such that the gate driver scans the gate lines in the display panel row by row at a first frequency F1 in the first stage, or scans the gate lines row by row at a second frequency F2 in the second stage. The source timing controller is connected to the dividing circuit, a voltage source, and the source driver, and configured to output a source timing control signal to the source driver, such that, under an action of the voltage source, a first voltage Vp1 is supplied to the sub-pixel through the data lines in the display panel in the first stage, or a second voltage Vp2 is supplied to the sub-pixel through the data lines in the second stage. When the first stage ends, a pixel voltage of the sub-pixel is a third voltage Vp3, F1<F2, and |Vp1|≥|Vp2|>|Vp3|.

Optionally, the second voltage Vp2 has a polarity opposite to the first voltage Vp1 and the pixel voltage Vp3.

Optionally, the first stage includes a low-frequency stage, and the second stage includes a high-frequency stage.

Optionally, each control period includes a number N of second stages, wherein N≥2 and N is a positive integer; and polarities of voltages respectively supplied to the sub-pixel in any adjacent two second stages are opposite to each other.

Optionally, values of the voltages sequentially supplied to the sub-pixel in the number N of second stages are sequentially increased.

Optionally, a maximum value of the voltages respectively supplied to the sub-pixel in the number N of second stages is smaller than or equal to the first voltage Vp1.

Optionally, scanning frequencies in the number N of second stages are equal to each other.

Optionally, in one control period, N×F1=F2.

Optionally, the voltages sequentially supplied to the sub-pixel in the number N of second stages form an arithmetic sequence, wherein a common difference X of the arithmetic sequence is |Vp1−Vp3|/N.

Optionally, the second frequency F2 is at least three times of the first frequency F1.

Other aspects of the present disclosure can be understood by those skilled in the art in light of the description, the claims, and the drawings of the present disclosure.

BRIEF DESCRIPTION OF THE DRAWINGS

To more clearly illustrate the embodiments of the present disclosure, the drawings will be briefly described below. The drawings in the following description are certain embodiments of the present disclosure, and other drawings may be obtained by a person of ordinary skill in the art in view of the drawings provided without creative efforts.

DETAILED DESCRIPTION

Reference will now be made in detail to exemplary embodiments of the disclosure, which are illustrated in the accompanying drawings. Wherever possible, the same reference numbers will be used throughout the drawings to refer to the same or the alike parts. The described embodiments are some but not all of the embodiments of the present disclosure. Based on the disclosed embodiments, persons of ordinary skill in the art may derive other embodiments consistent with the present disclosure, all of which are within the scope of the present disclosure.

Figure 1A:
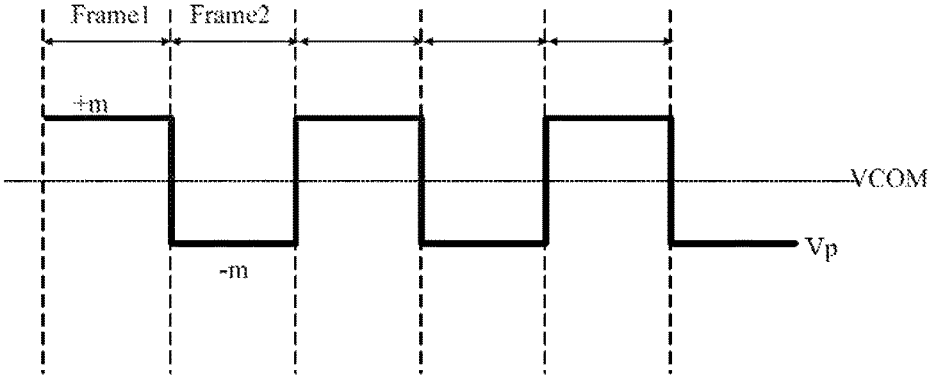
Figure 1a (Prior Art)
FIG. 1*a* illustrates a waveform diagram of polarity inversion of pixel voltage.
Figure 1B:
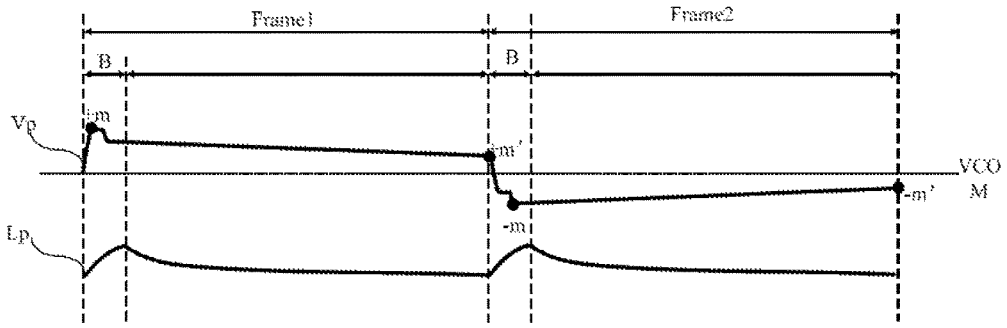
Figure 1b (Prior Art)
FIG. 1*b* illustrates a waveform diagram of display luminance during a polarity inversion process of pixel voltage.
Figure 2:
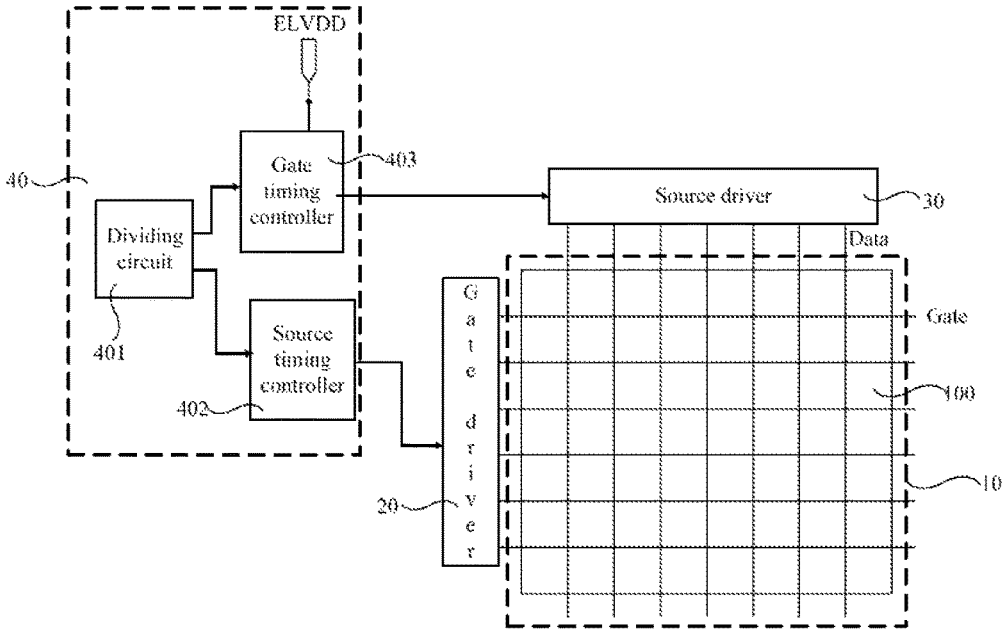
FIG. 2 illustrates a structural diagram of an exemplary display device consistent with disclosed embodiments.
Figure 3:
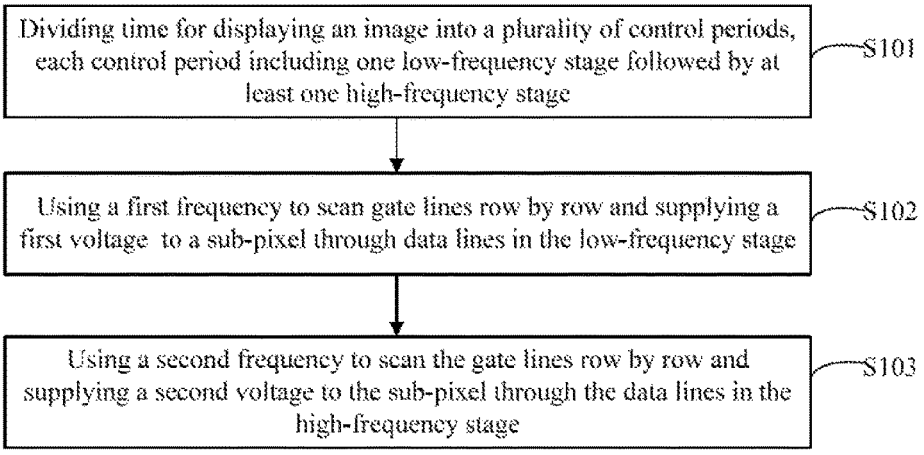
FIG. 3 illustrates a flow chart of an exemplary driving method of a display device consistent with disclosed embodiments.

The present disclosure provides a display device and a driving method of a display device. Referring to FIG. 2, the display device may include a display panel 10. The display panel 10 may include gate lines (e.g., see "Gate" in FIG. 2) and data lines (e.g., see "Data" in FIG. 2) that are vertically and horizontally crossed, and sub-pixels 100 defined by the crossing of the gate lines (Gate) and the data lines (Data). Referring to FIG. 3, the driving method may include the following steps.

Figure 4:
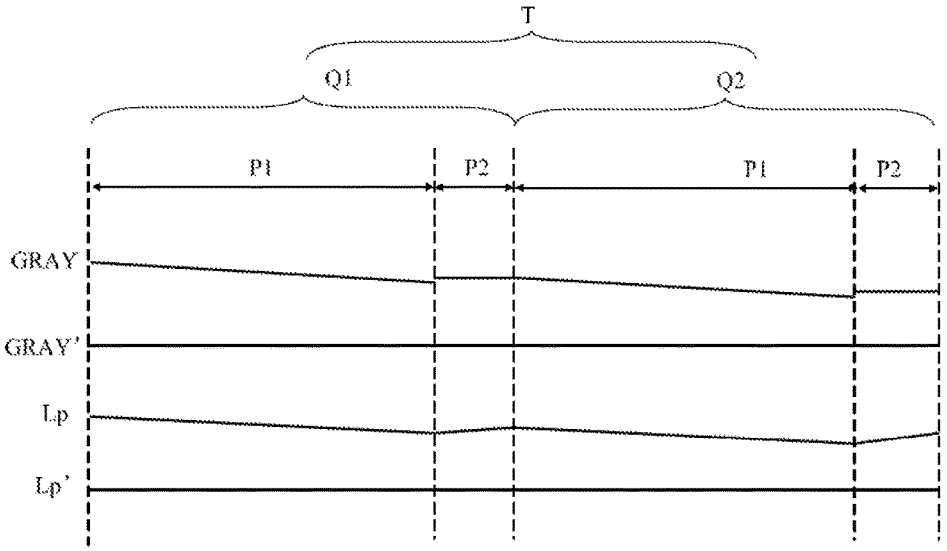
FIG. 4 illustrates a time dividing diagram for displaying an image consistent with disclosed embodiments.

Step 101: Referring to FIG. 4, time (or a period of time) 'T' for displaying an image may be divided into a plurality of control periods (Q1, Q2, . . . ), and each control period may include one low-frequency stage P1 sequentially followed by at least one high-frequency stage (e.g., P2, and P3).

Step 102: At the low-frequency stage P1, the gate lines (Gate) may be scanned row by row at a first frequency F1, and a first voltage Vp1 may be supplied to the sub-pixel 100 through the data lines (Data). The voltage supplied to the sub-pixel 100 through the data lines (Data) may refer to pixel voltage inputted into the sub-pixel 100. In addition, when the low-frequency stage P1 ends, the pixel voltage of the sub-pixel 100 may refer to a third voltage Vp3.

Step 103: At any one high-frequency stage (P2 or P3), the gate lines (Gate) may be scanned row by row at a second frequency F2, and a second voltage Vp2 may be supplied to the sub-pixel 100 through the data lines (Data). The second voltage Vp2 may have a polarity opposite to the first voltage Vp1 and the third voltage Vp3. Therefore, the deflection angles of the liquid crystal molecules at the low-frequency stage P1 and the high-frequency stage P2 may be different, and the aging of the liquid crystal molecules caused by that the liquid crystal molecules stay at a same deflection angle for a long time may be avoided.

Among these exemplary steps, F1<F2; and |Vp1|>|Vp2|>|Vp3|. Because F1<F2, the sub-pixel 100 in the high-frequency stage P2 may have a larger charge retention rate than the sub-pixel 100 in the low-frequency stage P1. Thus, the difference between the pixel voltages at the beginning and at the end of the high-frequency stage P2 may be small. Generally, the larger the value of the second frequency F2, the larger the charge retention rate of the sub-pixel 100. The second frequency F2 may be at least three times of the first frequency F1. Therefore, the sub-pixel 100 may have a high charge retention rate in the high-frequency stage P2 to reduce the difference of pixel voltages between the adjacent two control periods (such as Q1 and Q2) and, thereby to reduce the luminance difference.

The above image may be a dynamic image or a static image. When the image is a dynamic image, the grayscale value of the sub-pixel 100 pre-displayed in each image frame may be different. Therefore, to enable the dynamic image to be normally displayed, high frequency, such as 60 Hz, may usually be used to drive the gate lines (Gate) row by row. When the image is a static image, because the grayscale value of the sub-pixel 100 pre-displayed in a plurality of successive image frames may be the same, the frequency for scanning the gate lines (Gate) may be reduced to reduce the power consumption. Therefore, when displaying a static image, it is more often to use low frequency to scan the gate lines (Gate). Therefore, the following embodiments are examples where a static image is displayed. In this case, ideally, for the sub-pixel 100, referring to FIG. 4, in the time 'T' for displaying a static image, the theoretical grayscale value (GARE') remains unchanged and the theoretical luminance value (Lp') remains the same.

At this case, in theory, |Vp1|=|Vp3|. However, because the scanning frequency in the low-frequency stage P1 is low, for example, the scanning frequency of the gate lines (Gate)

may be reduced to approximately 6 Hz or less, the charge retention rate of the sub-pixel 100 may be lowered. Thus, referring to FIG. 5, when the low-frequency stage P1 ends, the pixel voltage of the sub-pixel 100 |Vp3|<|Vp1|. Therefore, in the low-frequency stage P1, the actual grayscale value (GARE) of the sub-pixel 100 cannot remain constant, and the actual luminance value (Lp) of the sub-pixel 100 cannot remain constant, and may be changed. Further, the actual luminance value (Lp) of the sub-pixel 100 may change significantly in the B region.

Figure 5:
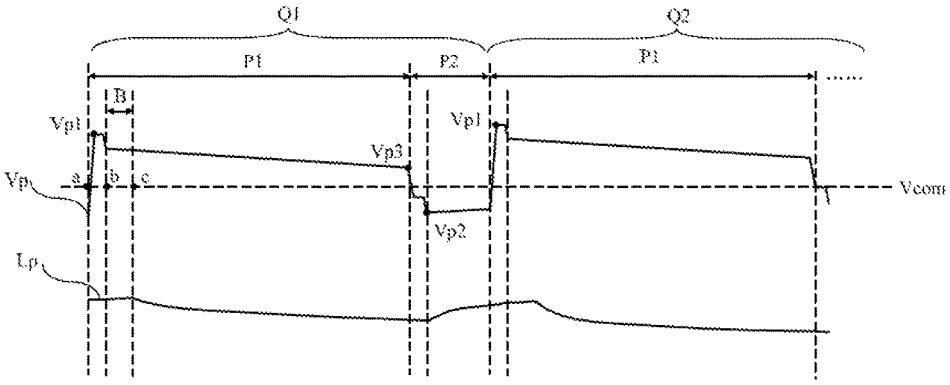
FIG. 5 illustrates a waveform diagram of display luminance corresponding to FIG. 4 consistent with disclosed embodiments.

In one embodiment, referring to FIG. 5, the sub-pixel 100 may start charging at a time point 'a', and may stop the charging at a time point 'b'. Because the time period between the time point 'a' and the time point 'b' is short, the difference between the pixel voltage of the sub-pixel 100 at the time point 'a' and the pixel voltage of the sub-pixel 100 at the time point 'b' may be small. Therefore, the deflection angle of the liquid crystal molecules may be regarded to start to change from the time point 'b', and the deflection of the liquid crystal molecules may gradually become stable after a time point 'c'. Therefore, in one image frame, the actual luminance value (Lp) of the sub-pixel 100 may change significantly between the time point 'b' and the time point 'c', i.e., in the B region.

In this case, in the next image frame, for example, the low-frequency stage P1 in the control period Q2 is shown in FIG. 5, the voltage value |Vp1| may still be inputted into the pixel electrode of the sub-pixel 100. Thus, appeared luminance difference between the low-frequency stage P1 in the control period Q1 and the low-frequency stage P1 in the control period Q2 may be large.

To reduce the above-described luminance difference, a plurality of high-frequency stages may be set between adjacent two low-frequency stages P1 by setting a low-frequency stage P1 sequentially followed by at least one high-frequency stage, such as P2, in each control period, such as Q1. In this case, because the second voltage Vp2 supplied to the sub-pixel 100 in the high-frequency stage P2 satisfies |Vp1|>|Vp2|>|Vp3|, when the low-frequency stage P1 ends, the pixel voltage of the sub-pixel 100 (value |Vp3|) may be compensated by the second voltage Vp2. On this basis, at least one high-frequency stage P2 may be set between the adjacent two low-frequency stages P1, and the second frequency F2 in the high-frequency stage P2 for scanning the gate lines (Gate) row by row may be larger than the first frequency F1 in the low-frequency stage P1 for scanning the gate lines (Gate) row by row.

Therefore, the charge retention rate of the sub-pixel 100 may be increased at the above-described high-frequency stage, and the difference between pixel voltages of the sub-pixel 100 at the beginning and at the end of the high-frequency stage P2 may be reduced. Thus, the voltage difference between the compensated pixel voltage and pixel voltage (value |Vp1|) supplied to the sub-pixel 100 in the next low-frequency stage (i.e., the low frequency stage P1 in the control period Q2) may be reduced, thus the luminance difference between the two adjacent low-frequency stages P1 may be reduced. Therefore, when displaying the image at low scanning frequency, the appeared luminance difference may be reduced by reducing the luminance difference between the adjacent two control periods.

In addition, because each control period, such as Q1, may include one low-frequency stage P1 sequentially followed by at least one high-frequency stage, such as P2, and the scanning frequency of the gate lines (Gate) in the above-described low-frequency stage P1 may usually be approximately 6 Hz or less, thus the display power consumption may be reduced.

Figure 6:
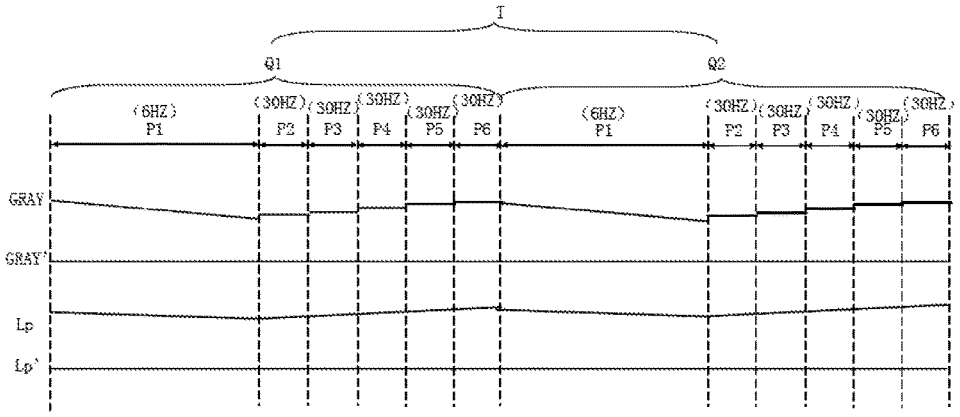
FIG. 6 illustrates another exemplary time dividing diagram for displaying an image consistent with disclosed embodiments.

Moreover, to increase the charge retention rate of the sub-pixel 100 in one control period, such as Q and to reduce the luminance difference between the two adjacent control periods, such as Q1 and Q2, referring to FIG. 6, each of the above control periods (Q1, Q2, . . . ) may include a number N of high-frequency stages (such as P2, P3, P4, P5, and P6), where N≥2 and N is a positive integer. Further, the polarities of the voltages respectively supplied to the sub-pixel 100 in any adjacent two high-frequency stages may be opposite to each other, thus the liquid crystal molecules can be controlled to be inverted between the adjacent two image frames to avoid aging of the liquid crystal molecules.

Figure 7:
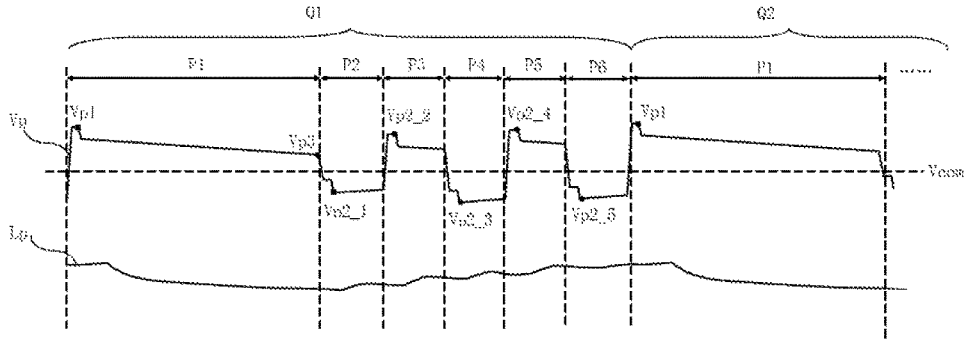
FIG. 7 illustrates a waveform diagram of display luminance corresponding to FIG. 6 consistent with disclosed embodiments.

On this basis, the values of the voltages sequentially supplied to the sub-pixel 100 in the number N of high-frequency stages may be sequentially increased. For example, referring to FIG. 7, the values of the voltages supplied to the sub-pixel 100 in the high-frequency stages, such as P2, P3, P4, P5, and P6, may satisfy |Vp2_1|<|Vp2_2|<|Vp2_3|<|Vp2_4|<|Vp2_5|. Therefore, when the low-frequency stage P1 ends, the pixel voltage (value |Vp3|) of the sub-pixel 100 may be gradually compensated by a plurality of high-frequency stages, thus the voltage difference between the pixel voltage (value |Vp2_5|) compensated by the last high-frequency stage P6 and the pixel voltage (value |Vp1|) of the sub-pixel 100 supplied in the next low-frequency stage (such as the low-frequency stage P1 in the control period Q2) may be reduced. Referring to FIG. 7, the curve of the pixel voltage Vp inputted to the sub-pixel 100 may be smoothed in the time 'T' for displaying one image, thus the curve of the actual grayscale value (GRAY) of the sub-pixel 100 may be smoothed and be close to the curve of the theoretical grayscale value (GRAY'). In this case, the curve of the actual luminance value (Lp) of the sub-pixel 100 may tend to be smoothed and be close to the curve of the theoretical luminance value (Lp'). Therefore, the purpose of a small display luminance difference may be achieved.

Further, referring to FIG. 6, when each control period (such as Q1, Q2, . . . ) includes the number N of high-frequency stages (such as P2, P3, P4, P5, and P6), the maximum value of the voltages supplied to the sub-pixel 100 in the number N of high-frequency stages may be less than or equal to the above first voltage Vp1. For example, referring to FIG. 7, the values of the voltages supplied to the sub-pixel 100 may be sequentially increased in the high-frequency stages, such as P2, P3, P4, P5, and P6, in other words, |Vp2_1|<|Vp2_2|<|Vp2_3|<|Vp2_4|<|Vp2_5|. The maximum value of the voltages supplied to the sub-pixel 100 in the number N of high-frequency stages may be the voltage |Vp2_5| supplied to the sub-pixel 100 in the high-frequency stage P6. In this case, when the maximum value |Vp2_5|≤|Vp1|, the pixel voltage (value |p2_5|) compensated in the last high-frequency stage P6 may be close or similar to the pixel voltage (value |Vp1|) of the sub-pixel 100 supplied in the next low-frequency stage (such as the low-frequency stage P1 in the control period Q2), thus the luminance difference between the two adjacent control periods (such as Q1 and Q2) may be further reduced or even eliminated.

Further, to simplify the control process, the scanning frequencies in the number N of high-frequency stages (such as P2, P3, P4, P5, and P6) may be equal to each other. On this basis, in one of the above control periods (such as Q1 or Q2), N×F1=F2.

For example, referring to FIG. 6, in one of the above control periods (such as Q1 or Q2), when the gate lines (Gate) are scanned at the first frequency F1 of 6 HZ in the low-frequency stage P1, the second frequency F2 used in the five high-frequency stages (such as P2, P3, P4, P5, and P6) may be 30 Hz. Thus, the time occupied by all the high-frequency stages may be equal to the time occupied by the low-frequency stage P1. Further, scanning frequency of the gate lines (Gate) in each high-frequency stage may be equal to each other, thereby facilitating simplifying the algorithm for allocating the scanning frequency of the gate lines (Gate) to achieve the purpose of simplifying the display drive control process. The above embodiment is described by using F1=6 HZ, F2=30 HZ, and N=5 as an example. When F1=15 HZ and F2=30 HZ, N=2, in other words, one of the above control periods (such as Q1 or Q2) may include two high-frequency stages. In addition, the frequencies in the low-frequency stage and the high-frequency stages as well as the number of the high-frequency stages are not limited.

Further, on the basis of sequentially increasing the values of the voltages supplied to the sub-pixel 100 in the number N of high-frequency stages (such as P2, P3, P4, P5, and P6), to further improve the smoothness of the curve of the actual luminance value (Lp) of the sub-pixel 100 in the time 'T' for displaying an image and to make the curve of the actual luminance value (Lp) be closer to the curve of the theoretical luminance value (Lp'), the voltages sequentially supplied to the sub-pixel 100 in the number N of high-frequency stages (such as P2, P3, P4, P5, and P6) may form an arithmetic sequence, and a common difference X of the arithmetic sequence may be |Vp1−Vp3|/N. Referring to FIGS. 6-7, in the case of five high-frequency stages (such as P2, P3, P4, P5, and P6) and X=0.08, when the sub-pixel are displaying different grayscale values (such as 225, 127, 64, 32, and 1), the pixel voltages inputted to the sub-pixel 100 in the respective stage corresponding to two adjacent control periods, such as Q1 and Q2 (P1-P6 in Q1 and P1 in Q2), are shown in Table 1.

TABLE 1

| | P1 | P2 | P3 | P4 | P5 | P1 | X |
|---|---|---|---|---|---|---|---|
| 225 | 5 | \|5 − 4X\| | \|5 − 3X\| | \|5 − 2X\| | \|5 − X\| | 5 | 0.08 |
| 127 | 3 | \|3 − 4X\| | \|3 − 3X\| | \|3 − 2X\| | \|3 − X\| | 3 | 0.08 |
| 64 | 2 | \|2 − 4X\| | \|2 − 3X\| | \|2 − 2X\| | \|2 − X\| | 2 | 0.08 |
| 32 | 1.5 | \|1.5 − 4X\| | \|1.5 − 3X\| | \|1.5 − 2X\| | \|1.5 − X\| | 1.5 | 0.08 |
| 1 | 0.6 | \|0.6 − 4X\| | \|0.6 − 3X\| | \|0.6 − 2X\| | \|0.6 − X\| | 0.6 | 0.08 |

In this case, when the low-frequency stage P1 ends, the pixel voltage (value |Vp3|) of the sub-pixel 100 may be progressively compensated in the plurality of high-frequency stages. Because the voltages sequentially supplied to the sub-pixel 100 in the number N of high-frequency stages (such as P2, P3, P4, P5, and P6) forms an arithmetic sequence, the voltage difference between compensated pixel voltages of any two adjacent high-frequency stages may be the same, i.e., the above common difference X. Therefore, referring to FIG. 8, the pixel voltage Vp of the sub-pixel 100 may be gradually increased after the plurality of high-frequency stages, and the fluctuation of the pixel voltage Vp in the voltage compensation process may be reduced. In addition, the pixel voltage (value |Vp2_5|) compensated in the last high-frequency stage P6 may be equal to the pixel voltage (value |Vp1|) of the sub-pixel 100 supplied in the next low-frequency stage (such as the low-frequency stage P1 in the control period Q2), thus the purpose of eliminating the luminance difference between the two adjacent control periods (such as Q1 and Q2) may be achieved.

Based on this, when the voltages sequentially supplied to the sub-pixel 100 in the number N of high-frequency stages (such as P2, P3, P4, P5, and P6) form an arithmetic sequence. Table 2 shows the actual grayscale values of the sub-pixel 100 at the same theoretical grayscale value, for example, in row 255 in Table 2, in the number N of high-frequency stages (such as P2, P3, P4, P5, and P6) and matched with the pixel voltages Vp inputted to the sub-pixel 100 at each of the high-frequency stages shown in Table 1. The actual grayscale values of the sub-pixels 100 may also form an arithmetic sequence, and a common difference of the arithmetic sequence X=2.

TABLE 2

| | P1 | P2 | P3 | P4 | P5 | P1 | X |
|---|---|---|---|---|---|---|---|
| 225 | 225 | \|225 − 4X\| | \|225 − 3X\| | \|225 − 2X\| | \|225 − X\| | 225 | 2 |
| 127 | 127 | \|127 − 4X\| | \|127 − 3X\| | \|127 − 2X\| | \|127 − X\| | 127 | 2 |
| 64 | 64 | \|64 − 4X\| | \|64 − 3X\| | \|64 − 2X\| | \|64 − X\| | 64 | 2 |
| 32 | 32 | \|32 − 4X\| | \|32 − 3X\| | \|32 − 2X\| | \|32 − X\| | 32 | 2 |
| 1 | 1 | \|1 − 4X\| | \|1 − 3X\| | \|1 − 2X\| | \|1 − X\| | 1 | 2 |

Figure 8:
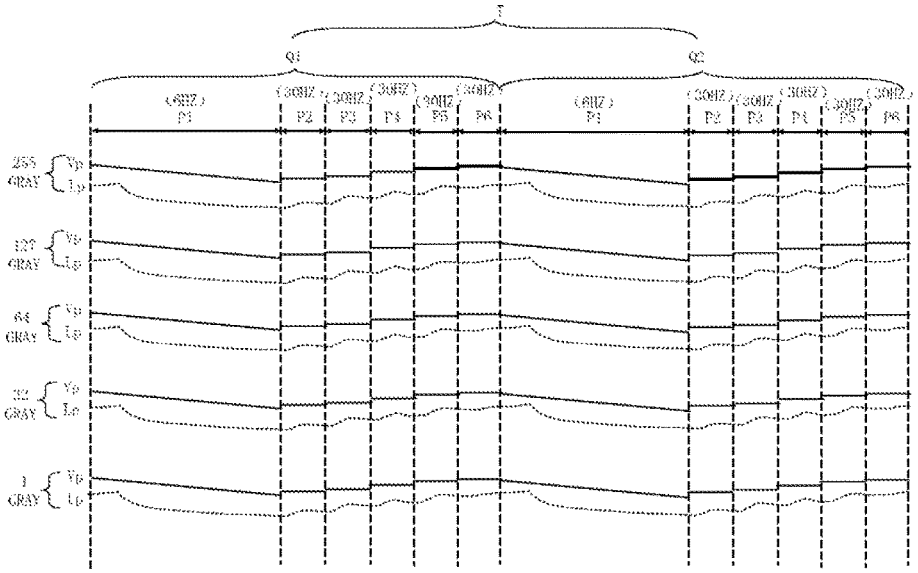
FIG. 8 illustrates a waveform diagram of pixel voltage and a waveform diagram of display luminance during a process where a plurality of high-frequency stages compensate for a voltage in a low-frequency stage consistent with disclosed embodiments.

Accordingly, referring to FIG. 8, when the actual grayscale values of the sub-pixel 100 at the same theoretical grayscale value, for example 255, in the number N of high-frequency stages (such as P2, P3, P4, P5, and P6) form an arithmetic sequence, the smoothness of curve of each grayscale value corresponding to Table 2 may be improved, and the luminance difference between different high-frequency stages may be reduced.

The above description is only an example to describe the pixel voltages of the sub-pixel 100 sequentially supplied in the plurality of high-frequency stages where the grayscale values are 225, 127, 64, 32, and 1. The sub-pixel 100 may also display other grayscale values without limitation.

A display device is also provided in the present disclosure. Referring to FIG. 2, the display device may include a display panel 10, a timing controller 40, a gate driver 20, and a source driver 30. The display panel 10 may include a plurality of sub-pixels 100 as shown in FIG. 2, and the plurality of sub-pixels 100 may be arranged in a matrix form. On this basis, the timing controller may include a dividing circuit 401, a gate timing controller 402, and a source timing controller 403.

The dividing circuit 401 may be configured to divide the time 'T' for displaying an image shown in FIG. 4 into a plurality of control periods (Q1, Q2, . . . ). Each control period, such as Q1, may include a low-frequency stage P1 sequentially followed by at least one high-frequency stage (such as P2 and P3).

The gate timing controller 402 may be connected to the dividing circuit 401 and the gate driver 20 for outputting the gate timing control signal to the gate driver 20, such that the gate driver 20 may scan gate lines (Gate) in the display panel 10 row by row at the first frequency F1 in the low-frequency stage P1, or may scan the gate lines (Gate) row by row at the second frequency F2 in the high-frequency stage P2.

The source timing controller 403 may be connected to the dividing circuit 401, a voltage source ELVDD, and the source driver 30 for outputting the source timing control signal to the source driver 30, such that under the action of the voltage source ELVDD, the first voltage Vp1 may be supplied to the sub-pixel 100 through the data lines (Data) in the display panel 10 in the low-frequency stage P1, or the second voltage Vp2 may be supplied to the sub-pixel 100 through the data lines (Data) in the high-frequency stage P2. When the low-frequency stage P1 ends, the pixel voltage of the sub-pixel 100 may be the third voltage Vp3, and |Vp1|>|Vp2|>|Vp3|. The second voltage Vp2 may have a polarity opposite to the first voltage Vp1 and the third voltage Vp3, and F1<F2.

In this manner, because each control period may include a low-frequency stage sequentially followed by at least one high-frequency stage, at least one high-frequency stage may be set between adjacent two low-frequency stages. In this case, because the second voltage Vp2 supplied to the sub-pixel in the high-frequency stage satisfies |Vp1|>|Vp2|>|Vp3|, when the low-frequency stage ends, even the value of the pixel voltage of the sub-pixel may decrease from |Vp1| to |Vp3|, when the high-frequency stage starts, the pixel voltage of the sub-pixel (value |Vp3|) may be compensated by supplying the pixel voltage with value of |Vp2| to the sub-pixel. On this basis, because the scanning frequency of the gate lines (Gate) in the high-frequency stage. i.e., the second frequency F2, is larger than the scanning frequency of the gate lines (Gate) in the low-frequency stage, i.e., the first frequency F1, the charge retention rate of the sub-pixel in the high-frequency stage may be improved, and the difference between the pixel voltages of the sub-pixel between at the beginning and at the end of the high-frequency stage may be reduced. Thus, the voltage difference between the pixel voltage compensated in the above high-frequency stage and the pixel voltage (value |Vp1|) supplied to the sub-pixel in the next low-frequency stage may be reduced, and the luminance difference between adjacent two low-frequency stages may be reduced, thereby the luminance difference between adjacent two control periods may be reduced. Therefore, when the image is displayed at a low scanning frequency, the appeared luminance difference may be reduced.

The description of the disclosed embodiments is provided to illustrate the present invention to those skilled in the art. Various modifications to these embodiments will be readily apparent to those skilled in the art, and the generic principles defined herein may be applied to other embodiments without departing from the spirit or scope of the invention. Thus, the present invention is not intended to be limited to the embodiments shown herein but is to be accorded the widest scope consistent with the principles and novel features disclosed herein.

What is claimed is:

1. A driving method of a display device, comprising:
supplying a first voltage Vp1 to a sub-pixel of the display device through data lines in a first stage of a control period for displaying an image, wherein:
a time for displaying the image includes a plurality of control periods, and the control period includes the first stage and at least a second stage following the first stage;
supplying a second voltage Vp2 to the sub-pixel through the data lines in the second stage, wherein:
a gate scanning frequency of the first stage is F1 and a gate scanning frequency of the second stage is F2,
when the first stage ends, the sub-pixel has a sub-pixel voltage Vp3, and
F1<F2, and |Vp1|>|Vp2|>|Vp3|.

2. The driving method according to claim 1, wherein:
the second voltage Vp2 has a polarity opposite to the first voltage Vp1 and the sub-pixel voltage Vp3.

3. The driving method according to claim 1, wherein:
the first stage includes a low-frequency stage;
the second stage includes a high-frequency stage;
any individual low-frequency stage is immediately preceded by one or more high-frequency stage; and
any individual low-frequency stage is immediately followed by one or more high-frequency stage.

4. The driving method according to claim 1, wherein:
each control period includes a number N of second stages, wherein N≥2 and N is a positive integer; and
polarities of voltages respectively supplied to the sub-pixel in any adjacent two second stages are opposite to each other.

5. The driving method according to claim 4, wherein:
values of the voltages sequentially supplied to the sub-pixel in the number N of second stages are sequentially increased.

6. The driving method according to claim 4, wherein:
a maximum value of the voltages respectively supplied to the sub-pixel in the number N of second stages is smaller than or equal to the first voltage Vp1.

7. The driving method according to claim 4, wherein:
scanning frequencies in the number N of second stages are equal to each other.

8. The driving method according to claim 7, wherein:
in one control period, N×F1=F2.

9. The driving method according to claim 8, wherein:
the voltages sequentially supplied to the sub-pixel in the number N of second stages form an arithmetic sequence, wherein a common difference X of the arithmetic sequence is |Vp1−Vp3|/N.

10. The driving method according to claim 1, wherein:
F2 is at least three times F1.

11. A display device, comprising:
a display panel, including sub-pixels;
a gate driver;
a source driver; and
a timing controller, including:
a dividing circuit configured to divide a time for displaying an image into a plurality of control periods, and each control period includes a first stage and at least one second stage following the first stage;
a gate timing controller connected to the dividing circuit and the gate driver, and configured to output a gate timing control signal to the gate driver, such that the gate driver scans gate lines in the display panel row by row at a first frequency F1 in the first stage, or scans the gate lines row by row at a second frequency F2 in the second stage;
a source timing controller connected to the dividing circuit, a voltage source, and the source driver, and configured to output a source timing control signal to the source driver, such that, under an action of the voltage source, a first voltage Vp1 is supplied to the sub-pixels through data lines in the display panel in the first stage, or a second voltage Vp2 is supplied to the sub-pixel through the data lines in the second stage, wherein:

when the first stage ends, a sub-pixel voltage of the sub-pixel is a third voltage Vp3, F1<F2, and |Vp1|>|Vp2|>|Vp3|.

12. The device according to claim 11, wherein:

the second voltage Vp2 has a polarity opposite to the first voltage Vp1 and the sub-pixel voltage Vp3.

13. The device according to claim 11, wherein:

the first stage includes a low-frequency stage;

the second stage includes a high-frequency stage;

any individual low-frequency stage is immediately preceded by one or more high-frequency stage; and any individual low-frequency stage is immediately followed by one or more high-frequency stage.

14. The device according to claim 11, wherein:

each control period includes a number N of second stages, wherein N≥2 and N is a positive integer; and polarities of voltages respectively supplied to the sub-pixel in any adjacent two second stages are opposite to each other.

15. The device according to claim 14, wherein:

values of the voltages sequentially supplied to the sub-pixel in the number N of second stages are sequentially increased.

16. The device according to claim 14, wherein:

a maximum value of the voltages respectively supplied to the sub-pixel in the number N of second stages is smaller than or equal to the first voltage Vp1.

17. The device according to claim 14, wherein:

scanning frequencies in the number N of second stages are equal to each other.

18. The device according to claim 17, wherein:

in one control period, N×F1=F2.

19. The device according to claim 18, wherein:

the voltages sequentially supplied to the sub-pixel in the number N of second stages form an arithmetic sequence, wherein a common difference X of the arithmetic sequence is |Vp1−Vp3|/N.

20. The device according to claim 11, wherein:

F2 is at least three times of F1.

* * * * *